US007068166B2

(12) United States Patent
Shibata et al.

(10) Patent No.: US 7,068,166 B2
(45) Date of Patent: Jun. 27, 2006

(54) BREAK-IN DETECTION SYSTEM

(75) Inventors: Norihiko Shibata, Chigasaki (JP); Fumiaki Tsuchiya, Ichikawa (JP); Toshihiro Nozawa, Hitachi (JP); Shinya Ishi, Hitachi (JP)

(73) Assignee: Sanki Eng. Co. Ltd., Tokyo (JP)

( * ) Notice: Subject to any disclaimer, the term of this patent is extended or adjusted under 35 U.S.C. 154(b) by 92 days.

(21) Appl. No.: 10/856,828

(22) Filed: Jun. 1, 2004

(65) Prior Publication Data

US 2004/0257218 A1 Dec. 23, 2004

(30) Foreign Application Priority Data

Jun. 17, 2003 (JP) ..... 2003-172119

(51) Int. Cl.
*G08B 13/00* (2006.01)

(52) U.S. Cl. ..... 340/541; 340/565; 340/552; 340/578; 348/152; 348/143; 250/221; 250/216; 367/136

(58) Field of Classification Search ..... 340/565, 340/541, 552, 506, 517, 521, 522, 555, 556, 340/564, 567, 578; 348/152, 154, 61, 143; 250/216, 221; 367/136, 135
See application file for complete search history.

(56) References Cited

U.S. PATENT DOCUMENTS

| | | | | |
|---|---|---|---|---|
| 4,609,909 | A * | 9/1986 | Miller et al. | 340/541 |
| 4,676,485 | A * | 6/1987 | Ciordinik et al. | 256/12 |
| 5,198,799 | A | 3/1993 | Pascale | |
| 5,392,027 | A * | 2/1995 | Brunot et al. | 340/561 |
| 5,448,222 | A * | 9/1995 | Harman | 340/566 |
| 5,627,934 | A | 5/1997 | Muhs | |
| 6,449,400 | B1 | 9/2002 | Watanabe et al. | |
| 6,504,479 | B1 * | 1/2003 | Lemons et al. | 340/541 |

FOREIGN PATENT DOCUMENTS

| | | |
|---|---|---|
| EP | 1 316 933 | 11/2002 |
| JP | 2001-296111 | 10/2001 |
| NL | 8 104 613 | 5/1983 |

OTHER PUBLICATIONS

Patent Abstracts of Japan; Publication No. 2001296111; Publication Date: Oct. 26, 2001; Applicant: Hitachi Cable Ltd.

* cited by examiner

*Primary Examiner*—Daniel Wu
*Assistant Examiner*—Daniel Previl
(74) *Attorney, Agent, or Firm*—Manabu Kanesaka

(57) ABSTRACT

A break-in detection system includes a detection sensor of an FBG type for detecting an intruder trying to climb over a fence around a premises, and a detection sensor of an OTDR type for detecting an intruder trying to demolish the fence. A fiber optic cable used as a detection sensor has a sensor core wire and a LAN transmission core wire arranged in parallel to form a LAN transmission channel. The LAN transmission core wire transmits videotaped image signals from ITV cameras and image control signals two ways between a monitoring room and an ITV control device. The LAN transmission channel is available for connection by IP telephone sets, a LAN terminal, a wireless LAN terminal, and an IP-BOX for internet communication. The system has excellent reliability and maintenance-free characteristics.

7 Claims, 5 Drawing Sheets

BREAK-IN DETECTION SYSTEM

BACKGROUND OF THE INVENTION

1. Field of the Invention

The present invention relates to a break-in detection system for detecting intrusion into a building or premises by means of sensors so as to operate in coordination with a monitoring system using with ITV cameras provided for the detection purpose.

2. Description of the Related Art

Recently, conventional and new systems are drawing a wide attention for prevention or surveillance of intrusion into buildings or premises. There are many systems in which detection sensors are installed in coordination with a monitoring system for alarm/confirmation purposes.

The detection sensors include a vibration sensor, an infra-red ray interception sensor, an electric field interception sensor, a mechanical tension sensor, surveillance monitor sensor for detecting occurrences of abnormal state of affairs, or the like. Further, there is proposed an optical fiber sensor using optical fibers (as disclosed in Japanese Patent Appln. Laid Open to Public No. 2001-296111), in which whether or not optical signals issued from the optical fibers are being reflected by an article subject to detection (or whether or not the article subject to detection is present at a predetermined position) is determined by the presence/absence of reflection.

The surveillance system operated in coordination with the detection sensors includes a recording method of ITV (Industrial Television) camera images and remote monitoring, an image analysis method, an alarm signal type method by use of an alarm unit and a wireless warning method.

The reliability of such break-in detection system is influenced by the sensitivity of detection sensors, the installation locations thereof and the resultant frequency of false alarms. If the system issues too many false alarms, the purposes of the use thereof will not be accomplished.

Further, there is a need for administering the break-in detection system to maintain the functions thereof in a predetermined state. If such maintenance is required in too many locations, the running cost thereof will increase.

For the above reasons, maintenance free break-in detection systems having superb reliability are much in demand.

As for reliability, tension sensor types may be recommended in the light of the most abundant track records though the conventional tension wire type has the problem of electromagnetic interference caused by its components and requires replacement of parts due to exposure to the external environment as well as aging with the result that there is the need for curtailment of the running cost and improvement in maintenance efficiency is reported to arise.

In terms of maintenance-free requirement, the surveillance system incorporating ITV cameras less susceptible to the external environmental factors (such as winds, snowfalls, temperatures, humidity, electromagnetisms or the like) may be recommended but calls for a large number of ITV cameras to be installed and long signal cables to be laid down in a long distance as far as the central monitor room if the surveillance area is extensive, thus requiring a large scale system.

The object of the present invention is to provide a break-in detection system excellent in reliability and meeting the maintenance free requirement.

SUMMARY OF THE INVENTION

In order to solve the above discussed problems, the fibro-optic detection sensors of an FBG (Fiber Bragg Grating) type and/or that of OTDR (Optical Time Domain Reflectometry) are used as the intrusion detection sensor in the intrusion detection system. Such detection sensors are used in coordination with a surveillance system incorporating ITV cameras connected to the transmission channel in networks such as LANs. Further, the signal transmission channel of said ITV cameras includes a fiber optic cable used as a detection sensor, said fiber optic cable being composed of a sensor core wire and a signal transmission core wire arranged in parallel to said sensor core wire. Still further, information communication system such as IP phone connected to the LAN by way of the transmission channel thereof is adapted to work in coordination with the intrusion detection system.

(1) A break-in detection system for detecting intrusion into a surveillance area with monitoring systems by an intrusion detection unit and ITV cameras maintained in coordination with each other, said intrusion detection unit comprising a fibro-optic detection sensor provided with fiber optic cables laid down in the surveillance area to work as members to detect intrusion and a transmission channel for intrusion detection signals; and said fiber optic cables including optical fibers and intrusion detection means to cause light pulses to enter the optical fibers such that intrusion detection signals are obtained from reflected light produced by deformation of said optical fibers, wherein said monitoring system is characterized in that each fiber optic cable provided in said detection sensor has core wires arranged therein in parallel to each other for signal transmission, said core wires being adapted to transmit image signals from the ITV cameras and image control signals to and from a ITV control system in a monitoring room is provided.

(2) Further, said ITV control system comprises means for sounding an alarm upon detection of intrusion by said intrusion detection unit; means for showing the picture taken by said ITV cameras; and means for automatically controlling conditions of pictures taken by the ITV cameras or manually controlling said conditions on an operating panel.

(3) Still further, said transmission channel using the signal transmission core wires is adapted for connection to an IP phone, a LAN terminal, a wireless LAN terminal and at least part of an Internet communication IP-BOX.

(4) Still further, said fiber optic cables of said detection sensor include an FBG type fibro-optic detection sensor laid down on top of a fence in said surveillance area to detect an intruder who tries to climb over the fence.

(5) Still further, said fiber optic cables include an OTDR type fibro-optic detection sensor laid down in zigzags on the fence to detect an intruder who tries to demolish the fence.

DETAILED DESCRIPTION OF THE EMBODIMENTS

Figure 1:
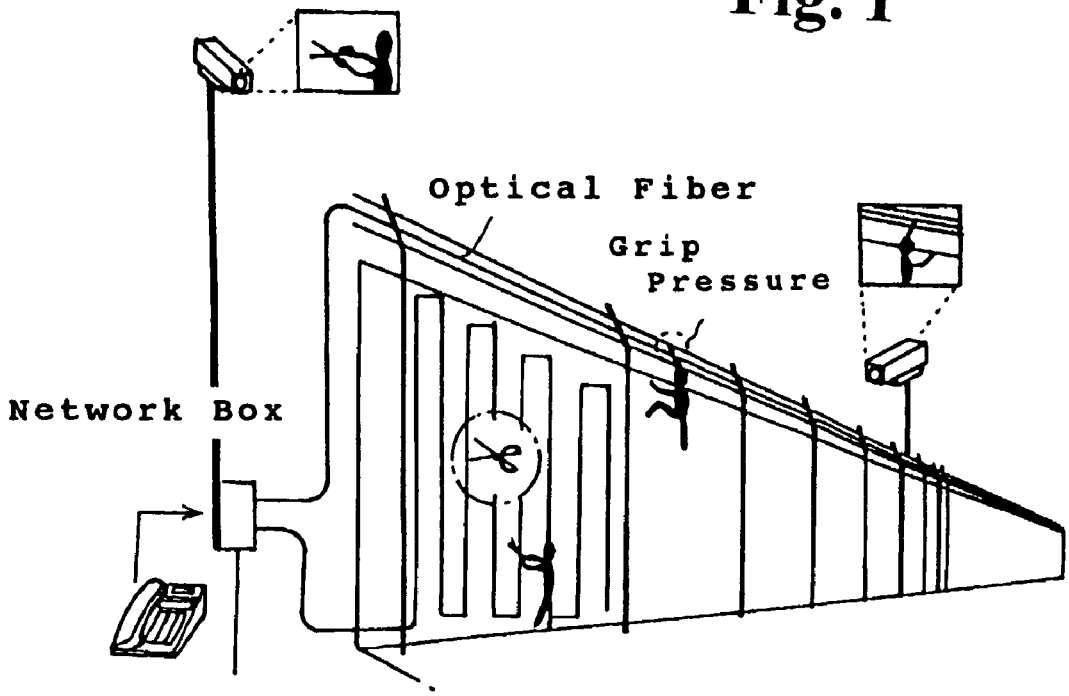
FIG. 1 is a view showing an outline of a break-in detection system embodied by the present invention.

FIG. 1 is the view of a mode to embody the present invention in which the structure of the break-in detection system is shown, the system being adapted to detect an intruder trying to climb over or demolish a fence.

There are provided in said detection system an FBG (Fiber Bragg Grating) type fibro-optic detection sensor 1 and an OTDR (Optical Time Domain Reflectometer) type fibro-optic detection sensor 2, both sensors being laid down in the surveillance area as intrusion signal detection members and intrusion signal transmission channels.

Figure 3:
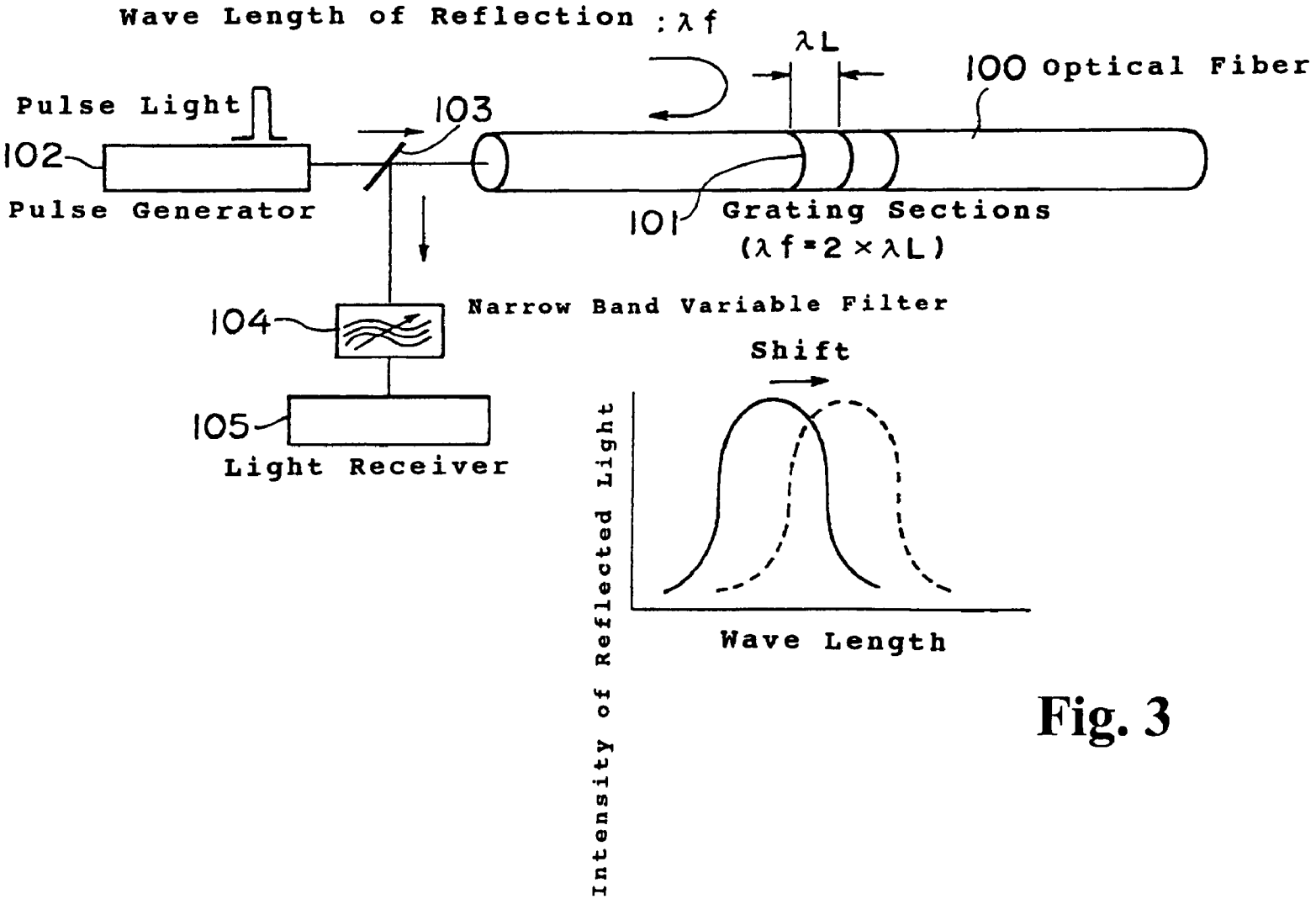
FIG. 3 is an explanatory figure showing the principle of the detection sensor of an FBG type in the embodiment.

FIG. 3 shows the principle of the FBG type fibro-optic detection sensor 1, in which grating sections 101 having different fiber glass refraction indexes are provided at predetermined intervals in longitudinal cross section through the optical fiber 100. Said grating sections 101 resonate and reflect only components having the wave length of two times the interval λL out of pulse lights coming from a light pulse generator 102. The thus reflected light has a wave length shifted in proportion to stretch strain in the grating sections 101. The reflected light component is guided by a half mirror 103 through a narrow band variable filter 104 to a light receiver 105 for detection. By use of this arrangement, it is possible to determine whether or not the stretch strain in the optical fiber exceeds a predetermined value.

In this embodiment, the fibro-optic detection sensor 1 is laid down on top of a fence as shown in FIG. 1 such that any touch or step by an intruder on the optical fiber will produce a stretch strain in the grating sections 101, which represent itself in the form of a wave length shift available for the purpose of detecting an occurrence of the intrusion by the intruder.

Figure 4:
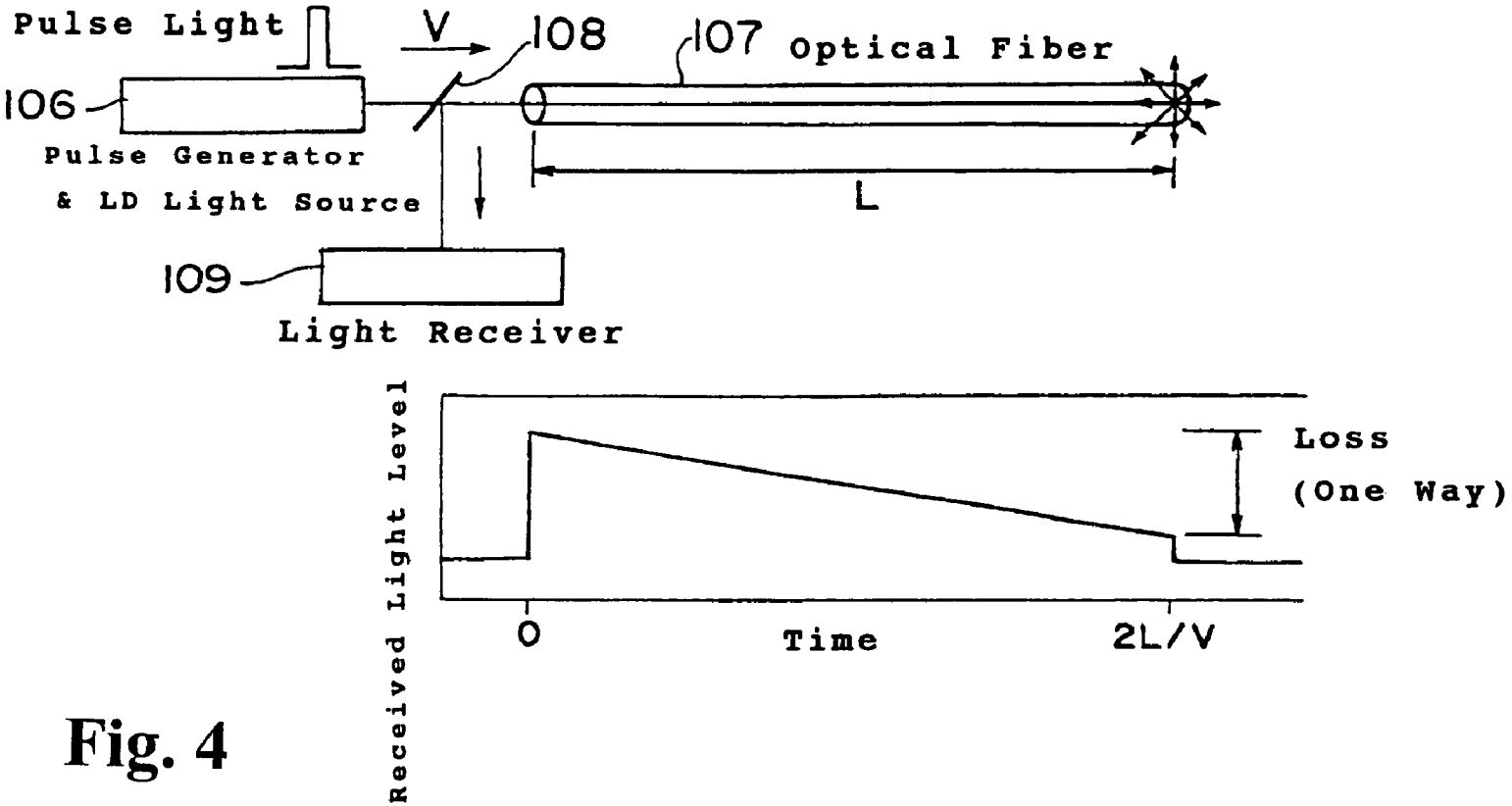
FIG. 4 is a view explaining the principle of the detection sensor of OTDR type used in the embodiment.
Figure 5:
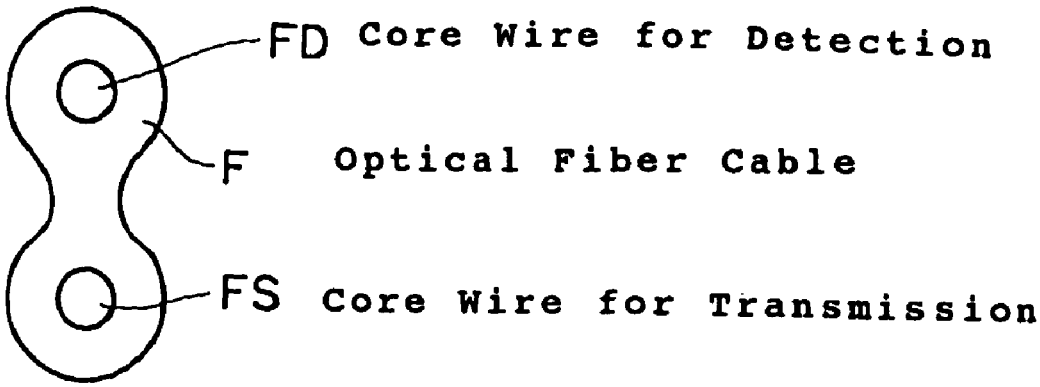
FIG. 5 is a cross sectional view showing the arrangement of core wires of the fiber cable used in the embodiment.

FIG. 4 explains the principle of an OTDR fibro-optic detection sensor 2. It is known that an optical fiber has sections having respective different refraction factors. When light passes through said sections, said light is refracted and scattered about due to said different refraction factors such that light rays having wave lengths equal to that of the incident light come out to the entrance where the light is introduced into the optical fiber. The detection sensor 2 makes use of this Rayleigh scattering light, where a light pulse issued from a light pulse generator 106 is introduced into the optical fiber 107 before Rayleigh scattering light produced therein is guided out thereof via a half mirror 108 to be received by a receiver 109 where any optical fiber strain, displacement and disconnection points are detected on the basis of the amount of light or the time required for reflection.

Figure 2:
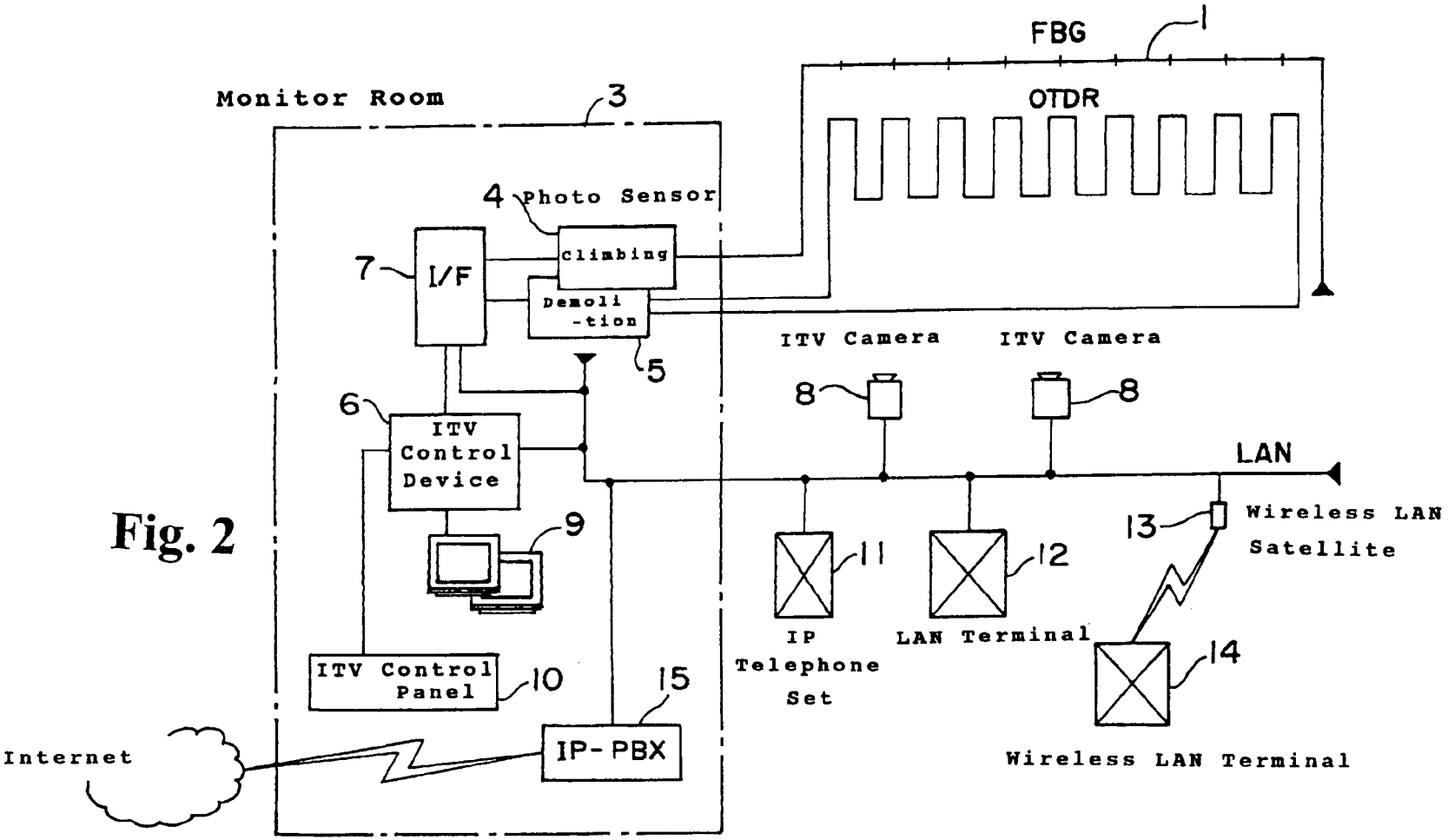
FIG. 2 is a view showing the arrangement of the detection sensors and the ITV cameras in the embodiment.

In this embodiment, the fibro-optic detection sensor 2 is laid down in zigzags on the fence as shown in FIG. 2 such that any attempt of the intruder at severing the optical fiber causes strain, displacement or disconnection thereof is detected as the presence of the intruder as well as the point of intrusion.

As shown in FIG. 2, the system has a monitor room 3 equipped with an ITV monitoring system in the center thereof and information input/output means provided in coordination with the detection sensors 1, 2 and ITV cameras 8 for detection and monitoring.

Therewithin, photo sensors 4 and 5 for detecting intrusion such as climbing and demolition actions are provided with the pulse generator 102 (shown in FIG. 3) to issue light pulses to the optical fibers 100 of said fibro-optic detection sensors 1 and 2 and a light receiver 105 to receive light reflected from said optical fibers 100. There is further provided a detection circuit based on a received light signal to obtain a detection output showing the attempt of the intruder to climb or demolish the fence.

Said detection sensors 1, 2 and said photo sensors 4, 5 constitute the intrusion detection device which uses the optical fibers 100 as signal transmission channel. It is, therefore, possible to lay down said intrusion detection device along a long distance while said photo sensors 4 and 5 are equipped in the monitoring room 3. If the area subject to surveillance is extensive, said area may be separated into several blocks to provide such detection devices in the respective blocks.

Next, there is provided ITV control device 6 in the monitor room 3 and is adapted to import detection signals (including the intrusion point signal) by way of an interface 7 as interrupting signals, receive monitoring images from two ITV cameras 8 allotted to each block of surveillance area and effect alarm and image display on plural ITV monitors 9.

The ITV control device 6 to coordinate said intrusion detection device and said ITV device functions to show an optimum image on the monitor 9 for each detection point to determine the break-in as well as to issue the intrusion alarm upon receipt of the intrusion detection signal from the intrusion detection device. Thus, the visual information about the intrusion to make an appropriate decision based thereupon is available to the monitoring personnel. Further, incorporation of the information on the detection point into the detection signal makes it possible to automatically train the two ITV cameras 8 to the detection point and if the intruder leaves the detection point, prevents the intruder's image from disappearing from the ITV camera monitors 9 because a movable object tracking control mechanism (which thereafter functions to locate the moving object and determine the moving direction thereof by means of image analysis).

For example, the two ITV cameras 8 are installed at an interval of 200 meters. If the picture taken thereby is to be displayed on the monitor 9 having a 14 inch screen, a field angle of approximately 2 cm is needed to visually recognize the intruder on the monitor. In this case, ITV cameras loaded with 15 or 17-fold zoom lens are needed. The monitoring distance of one camera is within a range of 200 meters at the maximum and 50 meters at the minimum to locate the figure of the intruder.

Further, the ITV control device 6 has a function to import an operation signal generated by operating the joy stick of the ITV control panel 10 or the like such that said ITV cameras 8 undergo control (direction, zoom, or the like) in accordance with said signal. This function enables the monitoring personnel to manually operate the ITV cameras 8 for more accurate monitor images.

Further, there is provided LAN information transmission means for enabling signal transmission between the monitor room 3 and the ITV cameras 8 at the surveillance site in the form of an IP telephone set 11, a LAN terminal 12, a wireless LAN satellite 13 and a wireless LAN terminal 14 which all enable communication between the inside and the outside of the monitor room 3 and further internet communication by way of IP-BOX 15 of the monitor room.

Of these, the IP telephone set 11 is made available by connecting an IP telephone set of the VoIP specification to an outlet prepared near the monitoring line by way of a modular cord such that the communication with not only the monitor room but also the monitoring center or the system design company enables technical support by experts in the system maintenance operation. Similarly, by connecting a LAN connector (TCP/IP) to another outlet of the IP telephone set 11, the LAN terminal 12 realizes the two-way transmission of information to and from the surveillance center and the security company. Further, the wireless LAN terminal 14 enables two-way information transmission by way of the wireless LAN satellite 13 installed near the surveillance line for the two-way transmission of maintenance information ancillary to the primary operation of the break-in detection system as well as the surveillance information and the measurement information.

It is to be noted that the net work box equipped for each ITV camera as exemplarily shown in FIG. 1 may be used as outlets for connecting the IP telephone set 11 and the LAN terminal 12 to constitute the LAN.

By use of the detection sensors 1 and 2, the ITV cameras 8 and the IP telephone sets 11 in the above system construction, information such as images, data, detection signals, audio signals are transmitted between the monitor room 3, the surveillance center and any other systems connected by way of the Internet. In this embodiment, optical fibers are used in the detection sensors 1 and 2 as the transmission channel for the above enumerated information. As an example of optical fiber cables used in the detection sensors 1 and 2, an optical fiber cable F is composed of a core wire FD for detection and the core wire FS for signal transmission are arranged in parallel to each other. For this purpose, an optical fiber cable having a plurality of core wires FD and FS may be used and laid down on top of the fence or side face thereof as shown in FIG. 1.

In this way, the core wire FD may be used for optical fiber cables as light transmission line for intrusion detection while the core wire FS may be used in the ITV cameras 8 and the IP telephone set 11 as a LAN information transmission line. Since the ITV cameras and the IP telephone set are installed near the surveillance area, the need for laid down leased wires for transmission from the remote monitor room or surveillance center to the surveillance area is eliminated while it is advantageous in improving the reliability and maintenance-free characteristic of the break-in detection system.

It is to be noted that although the optical fiber detection sensor 1 in accordance with the FBG system and the optical fiber detection sensor 2 in accordance with the OTDR system are installed in the embodiments, either one of said sensors may be used as a break-in detection system in case the surveillance area is limited to a concrete wall.

As explained in the foregoing, the present invention is characterized in the use of a fibro-optic detection sensor of FBG type and/or a fibro-optic detection sensor of OTDR type in coordination with a surveillance system by means of ITV cameras connected to a transmission channel of a LAN to form a break-in detection system in which the fiber optic cables to be used in the transmission channels of the LAN or the like have core wires for use as detection sensors. As a result, only the fiber optic cables and ITB cameras as equipment and materials are exposed to the outdoor air, thus solving the conventional problems in terms of the aerotolerancy and electromagnetic interference to assure reliability and meet the maintenance-free requirement. Further, the maintenance-free characteristics substantially reduce the running cost as well as the cost for structuring the system.

Furthermore, the present invention provides a break-in detection system working in coordination with an information communication system such as IP telephone sets connected to the transmission channel of a LAN or the like facilitate such that the intrusion detection is facilitated and speeded up while the reliability of the surveillance system is enhanced even more by placing the surveillance center and other surveillance systems into coordination in terms of information.

What is claimed is:

1. A break-in detection system for detecting intrusion into a surveillance area, the system comprising:

an intrusion detection unit;

a monitoring system for monitoring the detected intrusion, the monitoring system comprising industrial television cameras maintained in coordination with said intrusion detection unit; and an industrial television control system, wherein said intrusion detection unit comprises fibro-optic detection sensor means provided with fiber optic cables distributed in the surveillance area to work in coordination for detecting intrusion signals generated by means of external force exerted thereto, and as a transmission channel for said intrusion signals, said intrusion detection unit being capable of receiving said intrusion signals from said optical fiber cables, each fiber optic cable having first and second core wires arranged therein in parallel to each other for signal transmission, said intrusion detection unit being capable of enabling light pulses to enter said first core wire and be reflected in the form of said intrusion signals, and said second core wire being capable of transmitting televised image signals from the industrial television cameras and image control signals to and from the industrial television control system.

2. A break-in detection system as set forth in claim 1, wherein said industrial television control system comprises means for sounding an alarm upon detection of intrusion by said intrusion detection unit;

means for showing the televised image by said industrial television cameras; and means for automatically controlling conditions of images taken by the industrial television cameras or manually controlling said conditions on an operating panel.

3. A break-in detection system as set forth in claim 1, wherein said transmission channel is capable of connection to an Internet Protocol phone, a Local Area Network terminal, a wireless Local Area Network terminal and at least part of an Internet communication IP-BOX.

4. A break-in detection system as set forth in claim 1, wherein said fiber optic cables of said detection sensor comprise a Fiber Bragg Grating type fibro-optic detection sensor means provided on top of a fence in said surveillance area to detect an intruder who tries to climb over the fence.

5. A break-in detection system as set forth in claim 1, wherein said fiber optic cables comprise an Optical Time Domain Reflectometry type fibro-optic detection sensor provided in a zigzag pattern on a fence in said surveillance area to detect an intruder who tries to demolish the fence.

6. A break-in detection system according to claim 1, wherein said fiber optic cables comprise a Fiber Bragg Grating type sensor provided on top of a surveilled barrier for detecting the external force exerted thereto.

7. A break-in detection system according to claim 1, wherein said fiber optic cables comprise an Optical Time Domain Reflectometry type sensor provided in a zigzag pattern on a surveilled barrier for detecting the external force exerted thereto.

* * * * *